United States Patent [19]

Stampe

[11] Patent Number: 4,723,498

[45] Date of Patent: Feb. 9, 1988

[54] SAILBOAT RIGGING

[76] Inventor: Horst Stampe, Hardenbergstrasse 8, 2000 Hamburg 55, Fed. Rep. of Germany

[21] Appl. No.: 771,806

[22] Filed: Sep. 3, 1985

[30] Foreign Application Priority Data

Sep. 3, 1984 [DE] Fed. Rep. of Germany ..... 3432345

[51] Int. Cl.[4] ..... B63H 9/06

[52] U.S. Cl. ..... 114/102; 114/39.1; 114/98

[58] Field of Search ..... 114/39, 39.1, 98, 102, 114/103, 104, 105

[56] References Cited

U.S. PATENT DOCUMENTS 3,142,282 7/1964 Nichols ..... 114/39

3,874,313 4/1975 Doepner ..... 114/102

4,263,861 4/1981 Vicard ..... 114/39

*Primary Examiner*—Joseph F. Peters, Jr.

*Assistant Examiner*—Thomas J. Brahan

*Attorney, Agent, or Firm*—Cushman, Darby & Cushman

[57] ABSTRACT

The invention relates to a novel sailboat rigging, in which two masts placed without shrouds in a common thwartships plane are joined at the masthead and each have a main boom. Both main booms have a carriage that is displaceable in the longitudinal direction and is joined to the foot edge of a mainsail. The mainsail is embodied as a staysail and is guided on a stay that connects the masthead to the back end of the carriage. An articulated attachment of the two carriages by means of connecting rods to a swivel point disposed midway between the two masts offers the opportunity of automatically controlling the shortening and lengthening of the boom by means of the carriage.

3 Claims, 7 Drawing Figures

12
16
30
III
III
34
35
33
20
22
21
50
51
52
31
11
16
36
38
30
37
12

SAILBOAT RIGGING

BACKGROUND OF THE INVENTION

The invention relates to a sailboat rigging having two masts disposed spaced apart in a thwartships plane and joined at their masthead with fore and aft stays, each mast having a main boom with a mainsail.

SUMMARY OF THE INVENTION

The object of the present invention is to devise a novel, improved sailboat rigging, which is substantially better than a standard ketch or sloop rig for long turns when pursuing a downwind course, and which makes the boat easily maneuverable with one or two hands and avoids rope burns. In particular, however, the intent is to prevent the two mainsails from putting each other in the lee over a large part of their surface area.

To attain this object, the sailboat rigging of the above generic type is characterized in that a carriage for the foot edge of a mainsail that is embodied as a staysail is disposed on each main boom and is displaceable in the longitudinal direction of the boom; the end of the carriage nearer the mast is joined to the masthead via a stay that acts to attach the luff edge.

A further feature of the invention is that the carriage adjustment and thus the staysail adjustment in the longitudinal direction of the boom can be made automatic by articulating the ends of the carriage nearer the mast, via connecting rods, to a bearing point disposed stationary and midway between the two masts. In this respect, it is advantageous if the carriages of the two main booms are articulatedly joined via a releasable spreader, the length of the spreader corresponding to the distance between the masts at the level where the boom is located.

Further features of the invention are disclosed in the dependent claims.

Preferred embodiments of sailboat rigging are described in detail below, in conjunction with the drawings.

DETAILED DESCRIPTION

The sailboat shown in FIG. 1 will be described herein solely in terms of its rigging, because in principle the shape and body of the boat have no effect on the present invention.

Figure 1:
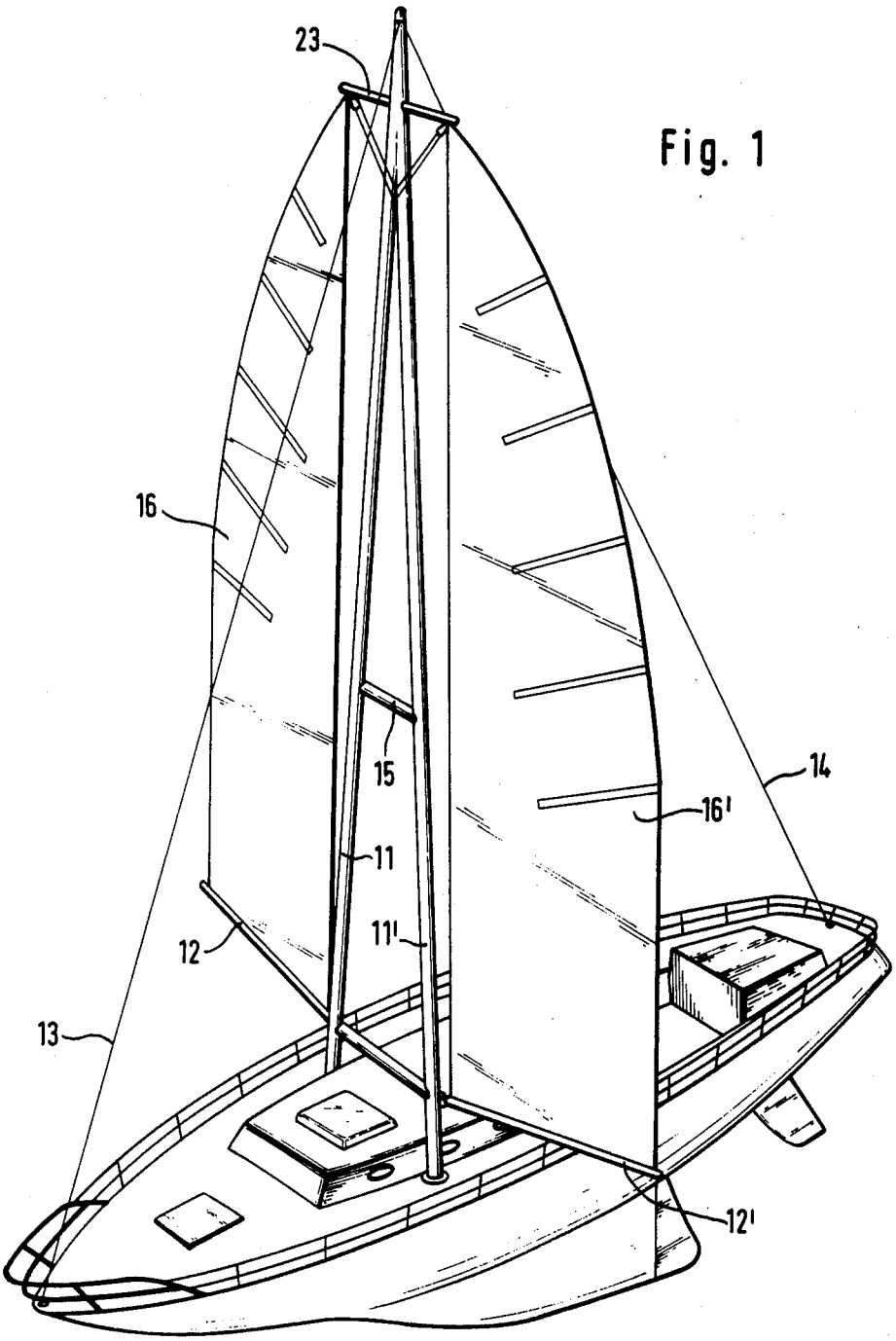
FIG. 1 is a perspective view of a sailboat provided with rigging in accordance with the invention and in the downwind sailing position.

The rigging of the sailboat according to FIG. 1 includes two masts 11 and 11', disposed in a common thwartships plane, which are joined together at the masthead. In the longitudinal direction of the boat, the approximately triangular mast arrangement is retained by a forestay 13 and an aft stay 14, which serve as mutual connection and bracing for the respective masts. Shrouds have been dispensed with, because the two masts 11 and 11' have been made sufficiently rigid via a bracing arrangement 15.

Each of the two masts 11 and 11' is provided with a respective main boom 12 and 12'. The two mainsails 16 and 16' are embodied as staysails. On each staysail, the luff edge 20 is attached via stay rings 21 to a stay 22, which extends from crosstrees 23 in the vicinity of the masthead 11 to the aft end of a carriage 30, which will be discussed in detail later herein.

Figures 2, 3:
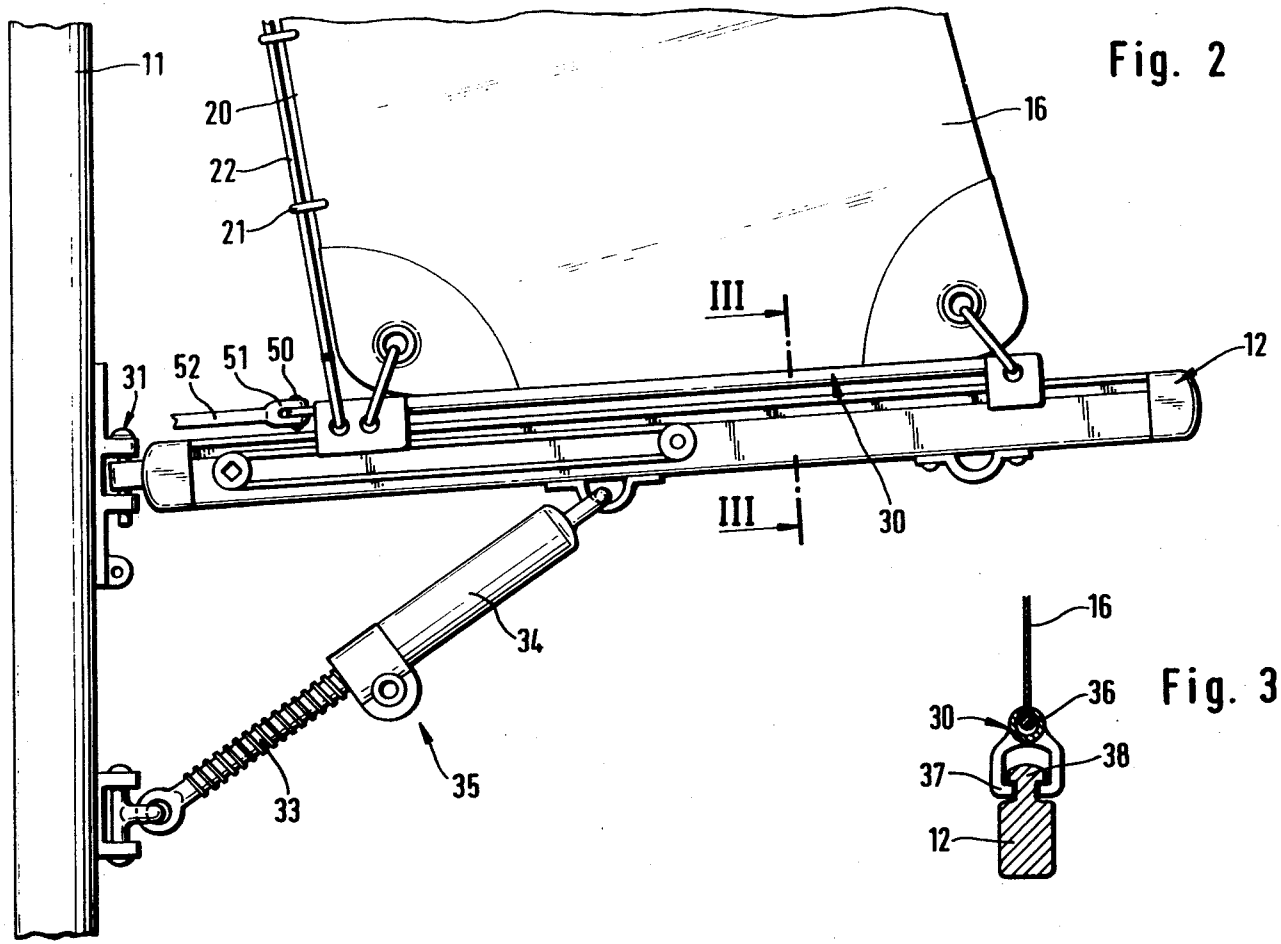
FIG. 2 is a schematic side view of the mast, main boom and a staysail that is longitudinally displaceable on the main boom with a carriage.
FIG. 3 is a cross section taken along the line III—III of FIG. 2.
Figure 4:
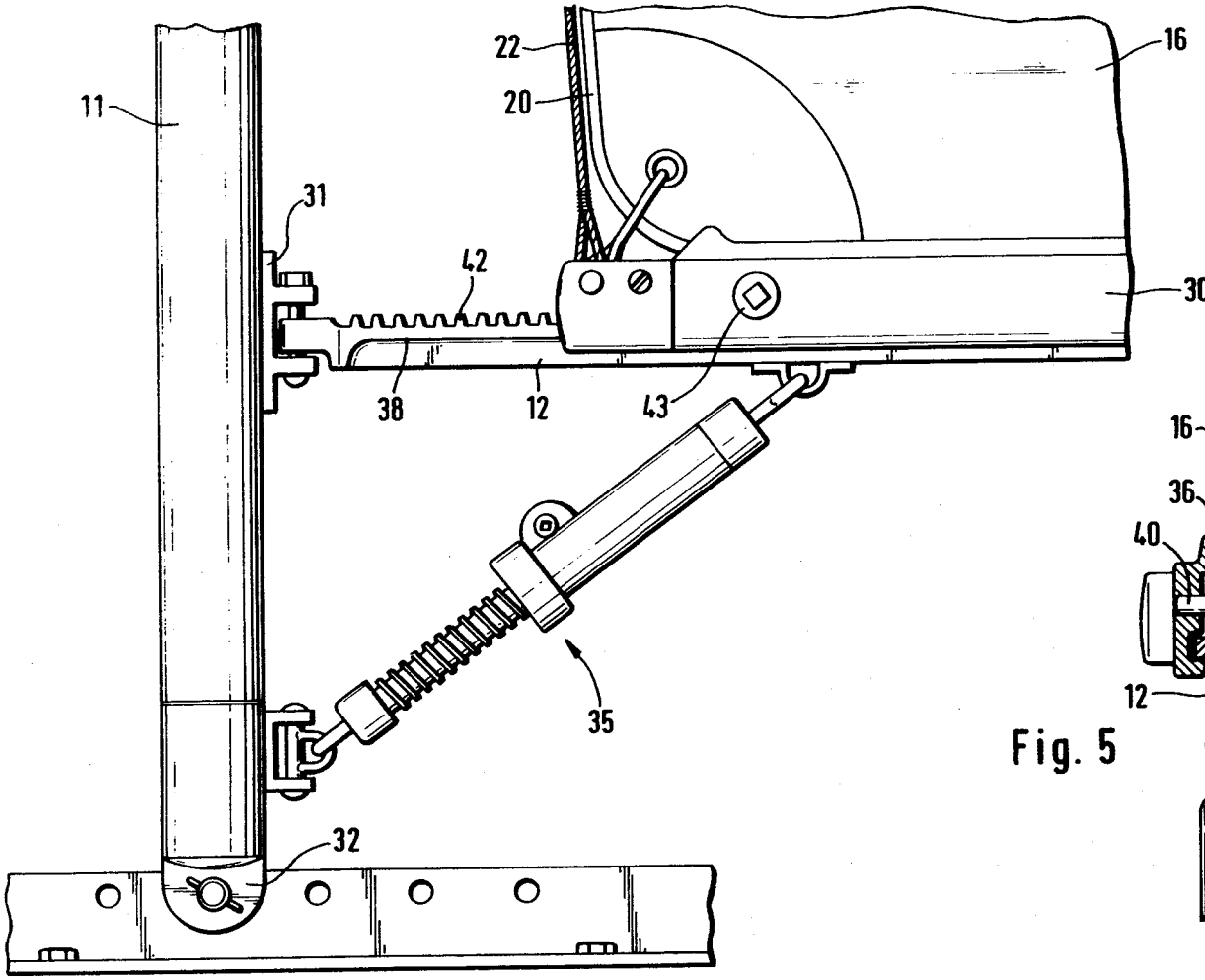
FIG. 4 is a detail of FIG. 2, shown on a larger scale.

As shown in FIGS. 2 and 4, each main boom 12 is joined to its mast 11 with a conventional boom bearing 31. Between the foot 32 of the mast and the main boom 12, a boom downhaul 35 comprising a worm 33 and a shock absorber 34 can be provided.

The particular feature of the rigging according to the invention is that the mainsail 16 is not attached directly to the boom 12 with its foot edge 36; instead, it is attached to a carriage 30, which is displaceable on the boom 12 in the longitudinal direction of the boom. To provide guidance, the carriage 30 may grip a boom rail 38, extending in the longitudinal direction, with a carriage foot 37.

Figure 5:
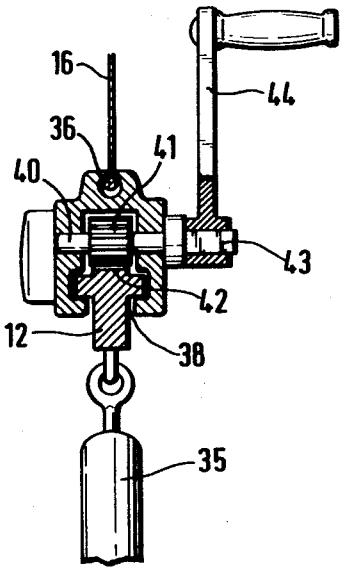
FIG. 5 is a schematic cross section through a manual drive mechanism for the rack and pinion connection between the boom and the carriage of FIG. 4.

A manually movable drive mechanism may be provided for axially adjusting the carriage 30 on the boom 12, as shown in cross section by FIG. 5. Located on a horizontal transverse shaft 40 in the carriage 30 is a pinion 41, which is capable of engaging a rack 42 embodied on the top of the boom 12. The shaft 40 is extended laterally from the carriage 30, where it is provided with a square projection 43, on which a hand crank 44 can be mounted. Naturally, a locking device is provided as well, but is not shown in detail.

It is apparent from the above description that the two mainsails 16 and 16' can be pivoted independently of one another with their booms, and can also be moved forward or backward to a variable extent in the axial direction. Since the mast arrangement uses no shrouds at all, the two sails 16 and 16' can also be brought into a ballooning butterfly position as shown in FIG. 1, without the danger of rope burns. Since the two sails 16 and 16' can be moved independently of one another by means of their carriages 30, in every sailing position the sail surfaces can be aligned in such a way that they shield each other only minimally from the wind, or in other words put each other only minimally in the lee.

Figure 6:
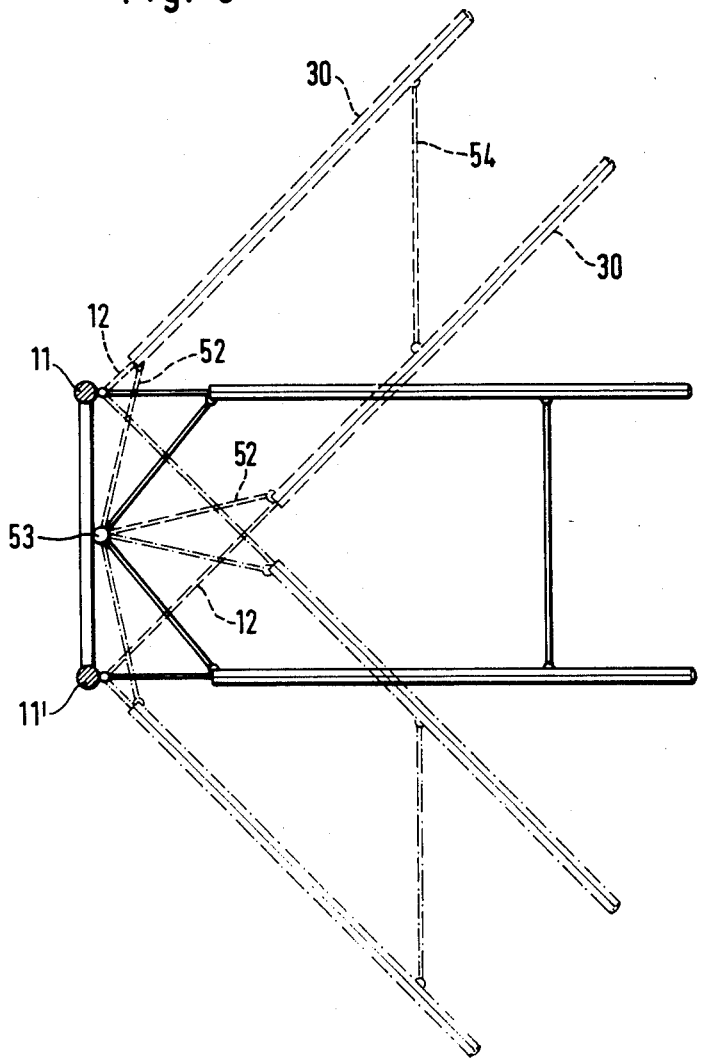
FIG. 6 is a sketch explaining the principle of the automatic control for lengthening the main boom by means of connecting rods.

In addition to purely manual actuation of the carriages 30 on the booms 12, it is also possible to provide automatic control. To this end, a vertical bearing bolt 50 (FIG. 4) is provided on the rear end of the carriage 30, bearing the bearing eye 51 of a connecting rod 52, the other end of the connecting rod being articulatedly joined to a swivel point 53 midway between the two masts 11 and 11'. By means of this articulated connection, each boom, as shown in FIG. 6, is automatically lengthened with its carriage, whenever it is pivoted from the side toward the middle of the boat. This lengthening of the boom by means of the carriage has the effect—as will be understood from the foregoing—of shifting the associated main staysail aft.

If the two carriages 30 of the two main booms, as FIG. 6 also shows, are joined together via a preferably releasable spreader 54, the length of which agrees substantially with the spacing between the masts at the level where the boom is articulated, then an exact parallel guidance of both booms and both sails is attained.

According to a further modification of the invention, it is also possible to provide a roll reef apparatus between the carriage 30 and the crosstrees, instead of the mast stays 22. In this roll reef apparatus, the rollup shaft then embodies the stay. The drive mechanism of the rolling reef apparatus is embodied in a conventional fashion, such as is known in rolling reef apparatuses for a jib.

Naturally strains can arise in a connection between the main boom 12 and the carriage 30 as shown in FIGS. 2 and 4, especially if the carriage 30 can or must travel relatively long distances along the main boom 12. In such cases, extensible connections are therefore provided between the ends of the carriage 30 and the ends of the foot edge 36, for instance in the form of spring elements or elastic intermediate parts.

Figure 7:
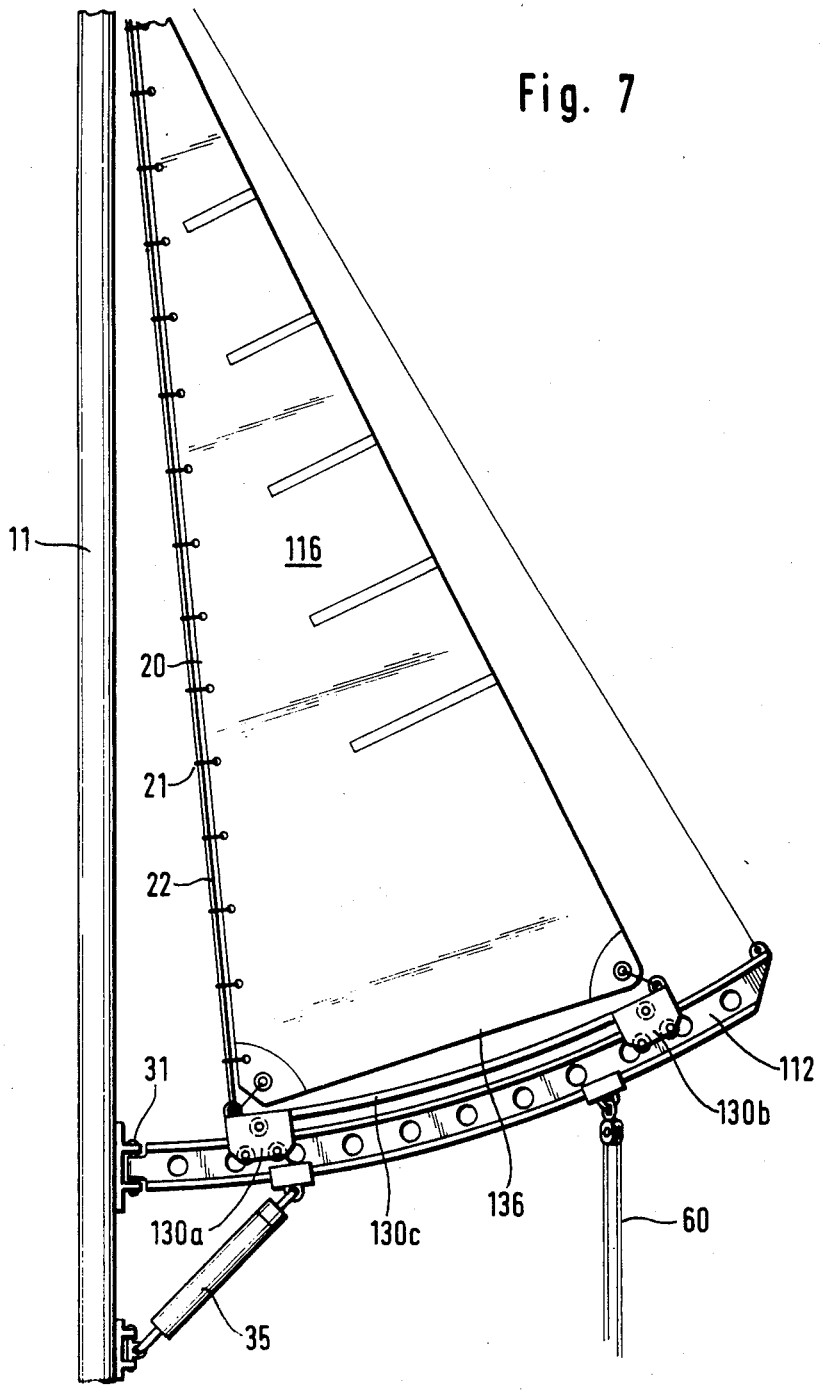
FIG. 7 is a view, similar to FIG. 2, of a modified embodiment of the invention.

For a sailboat rigging according to the invention in which the above-mentioned strains cannot arise, a favorable embodiment is shown in FIG. 7, in which structural elements corresponding to those of FIG. 2 have the same reference numerals.

In this case, the main boom 112 is bent upward in an arc. The radius of this curvature corresponds to the length of the forestay 22 of the mainsail 116. Thus if the mainsail is pivoted about the masthead, the foot edge 136 of the mainsail 116 continuously maintains the same configuration—considered purely geometrically—with respect to the curved main boom.

The carriage belonging to this curved main boom 112 is embodied as a carriage truck, comprising a forward guide element **130*a*, a rear guide element 130*b*, and a rod 130*c* connecting these two elements 130*a* and 130*b*. Because of the relatively short length of the carriage elements 130*a* and 130*b*, jamming cannot occur with respect to the upper edge guidance of the main boom 112, which is T-shaped in embodiment, similarly to FIG. 3. Guide tracks, preferably rollers arranged in a configuration of three, are located in the guide elements 130*a* and 130*b*. The sheet 60 can engage the lower edge of the curved main boom 112** in a manner known per se.

It will be appreciated from the above description that the novel rigging according to the invention makes many entirely new sailing positions possible, because the mainsails can be deployed independently of one another; it is even possible to extend them toward the outer sides at angles of more than 90°, for instance. When sailing with headwinds the sails can always be kept out of the lee by shifting the luff sail aft, using its carriage, and this can also be accomplished by the automatic guidance mentioned above.

What is claimed is:

1. A sailboat rigging having two spaced apart masts disposed approxiamtely in a thwartships plane, each said mast having a main boom for carrying a mainsail in cooperation with the associated mast, each said boom having a carriage, each said carriage having means for engaging its associated boom so that said carriage is movable in the longitudinal direction of said boom, each said carriage having a length approximately equal to the length of the foot edge of a sail, each said carriage having opposite ends with one of said ends being closer to an associated mast than the opposite end, each said carriage having means connecting said one end to a swivel point, wherein between each boom and respective carriage, a rack-and-pinion mechanism is provided with each rack being disposed on an associated boom and each pinion being rotatable with a hand crank drive with each pinion being disposed on said carriage.

2. A sailboat rigging having two spaced apart masts disposed approximately in a thwartships plane, each said mast having a main boom for carrying a mainsail in cooperation with the associated mast, each said boom having a carriage, each said carriage having means for engaging its associated boom so that said carriage is movable in the longitudinal direction of said boom, each said carriage having a length approximately equal to the length of the foot edge of a sail, each said carriage having opposite ends with one of said ends being closer to an associated mast than the opposite end, said one end of each of said carriages being articulated via a connecting rod to a bearing point disposed stationarily and midway between said two masts.

3. A sailboat rigging having two spaced apart masts disposed approximately in a thwartships plane, each said mast having a main boom for carrying a mainsail in cooperation with the associated mast, each said boom having a carriage, each said carriage having means for engaging its associated boom so that said carriage is movable in the longitudinal direction of said boom, each said carriage having a length approximately equal to the length of the foot edge of a sail, each said carriage having opposite ends with one of said ends being closer to an associated mast than the opposite end, each said carriage having means connecting said one end to a swivel point, wherein a forestay having a given length is provided and said main booms are bent upward in an arc, via a radius which corresponds to said length of said forestay of each mainsail.

* * * * *